United States Patent [19]

Kanemura

[11] 4,236,660

[45] Dec. 2, 1980

[54] SOLENOID CLUTCH MECHANISM

[75] Inventor: Tom T. Kanemura, Redwood City, Calif.

[73] Assignee: Champion International Corporation, Stamford, Conn.

[21] Appl. No.: 6,743

[22] Filed: Jan. 26, 1979

[51] Int. Cl.[3] ..... B65H 17/30; B65H 17/22

[52] U.S. Cl. ..... 226/95; 226/115; 226/152; 226/156

[58] Field of Search ..... 226/95, 115, 108, 120, 226/152, 154, 155, 156, 122, 123, 134, 147, 148, 157

[56] References Cited

U.S. PATENT DOCUMENTS

| | | | |
|---|---|---|---|
| 2,934,339 | 4/1960 | Davis et al. | 226/156 |
| 3,511,426 | 5/1970 | Whitmore et al. | 226/156 |
| 3,630,424 | 12/1971 | Rau | 226/95 |
| 3,668,942 | 6/1972 | Landis et al. | 226/157 |

*Primary Examiner*—Stanley N. Gilreath
*Attorney, Agent, or Firm*—Evelyn M. Sommer

[57] ABSTRACT

A solenoid clutch mechanism for providing intermittent rotation of a feed roller in a web feeding apparatus. The clutch mechanism includes a solenoid having a reciprocable plunger connected to a pivotable arm in abutment with a cam mounted on a driven shaft. The driven shaft is drivingly connected to the cam by means of an over-center coil spring. Coupled to the cam is a gear train in driving relation to the feed roller. The driven shaft will rotate relative to the cam as long as the arm is in abutment with the cam. Upon retraction of the solenoid plunger the arm is raised permitting the cam to rotate by virtue of the spring drive connection to the driven shaft in turn causing rotation of the gear train to drive the feed roller to advance a web.

4 Claims, 3 Drawing Figures

SOLENOID CLUTCH MECHANISM

BACKGROUND OF THE INVENTION

This invention relates to a solenoid clutch mechanism, and more particularly, a solenoid clutch mechanism for use with web feeding apparatus.

Usually, in the handling of sheet material for forming envelopes or the like, the sheet must be intermittently stopped and treated at various stations. This invention provides a mechanism for intermittently stopping the feeding of a sheet-like web between a pair of feed rollers so that the web may be treated while stationary and then advanced for subsequent processing.

In order to be operational, the power train driving the web feed rollers should remain engaged in order that the various operations performed on the web can be simultaneously carried out. However, the feed rollers must be immobilized at the work station. The solenoid clutch mechanism of the present invention is used for this purpose.

SUMMARY OF THE INVENTION

In accordance with the invention, a solenoid is provided having a plunger pivotably connected to one end of a horizontal pivot arm. The arm extends into the path of rotation of a cam mounted on a driven roller shaft. The shaft is connected by an over-center spring to the cam. The cam is coupled to a gear train which drives a second roller downstream from the driven roller.

The second roller acts in conjunction with a vacuum roller, which when activated will hold a fed web to its surface precluding advancement of the web while it is being treated. During this operation, the feed roller on top of the vacuum roller has to be inactivated.

By virtue of the arm bearing against the cam, the gear train connected to the feed roller is inactivated. The driven roller shaft rotates relative to the cam and the stationary feed roller. Upon retraction of the solenoid plunger by an electronic signal received by the plunger, the arm is lifted upwardly relative to the cam. The driven roller through its over-center spring attachment to the cam causes the cam to rotate, driving the gear train and the feed roller.

Simultaneously, the vacuum induced in the vacuum roll is relieved and the web advanced between the driven roller and vacuum roll.

A leaf spring connected to the top of the pivot arm forces the pivot arm back downwardly into abutment with the cam after one complete revolution of the cam to inactivate the gear train and feed roller until a subsequent signal is received. This enables another portion of the fed web to be processed as before.

BRIEF DESCRIPTION OF THE DRAWINGS

Further objects and advantages of the invention will become apparent from the following description and claims, and from the accompanying drawing, wherein.

DETAILED DESCRIPTION OF THE PREFERRED EMBODIMENT

Figure 1:
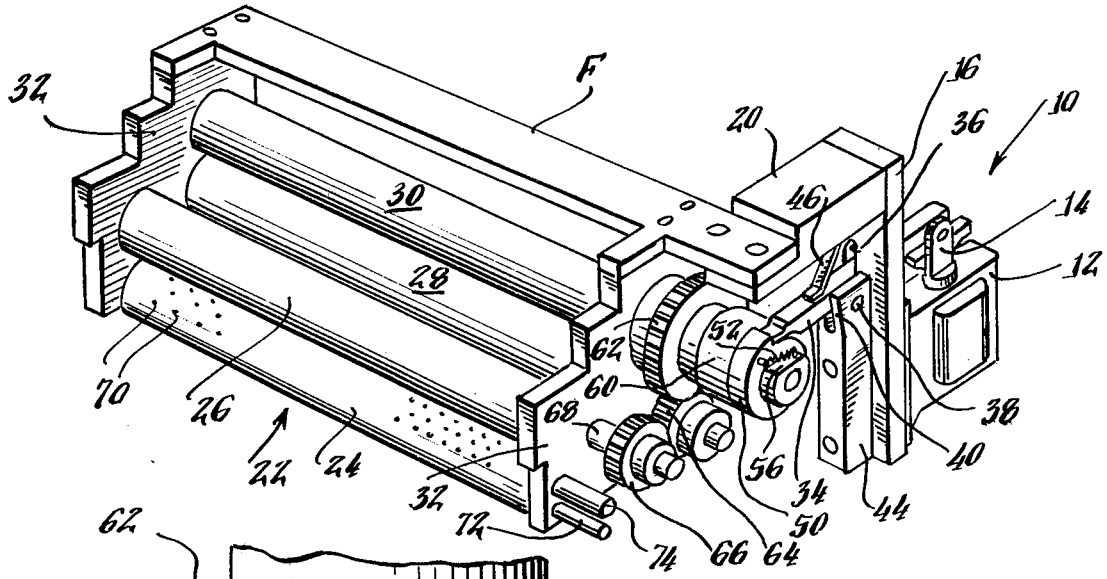
FIG. 1 is a perspective view of the solenoid clutch mechanism of the present invention mounted adjacent a pair of web advancing rollers.
Figure 3:
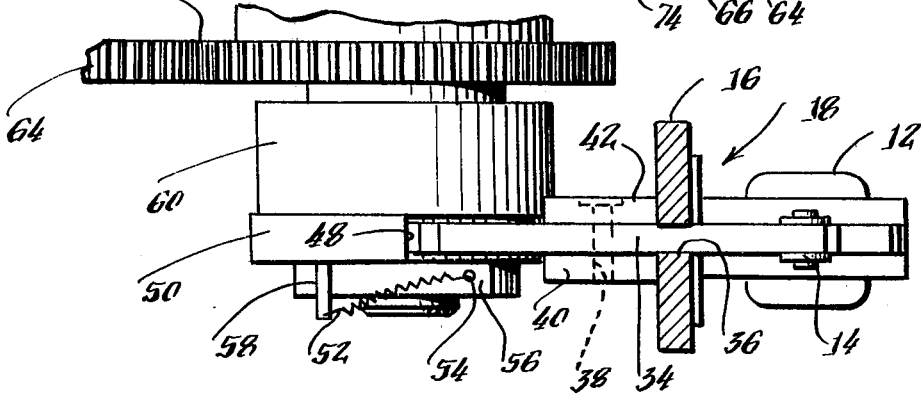
FIG. 3 is a cross sectional view taken substantially along the plane indicated by line 3—3 of FIG. 2.

Referring now to the drawing in detail, wherein like numerals indicate like elements throughout the several views, the solenoid clutch mechanism 10 of the present invention includes an electrically operated solenoid 12 provided with a vertical plunger 14.

The solenoid 12 is mounted on the longer leg 16 of an L-shaped bracket 18. The shorter leg 20 of bracket 18 is connected to the frame F of a web feed apparatus 22 consisting of pairs of horizontal rollers or shafts 24, 26 and 28, 30 mounted between a pair of facing side plates 32 and 34 of the frame F.

The plunger 14 of solenoid 12 is pivotably connected to one end of a generally horizontal arm 34. Arm 34 extends through an elongated vertical slot 36 formed in the longer leg 16 of bracket 18. Arm 34 is pivoted intermediate its ends by a pivot pin 38 extending between a pair of bifurcated arms 40 and 42 on the upper end of a mounting bracket 44 connected to the front surface of the longer leg 16 of L-shaped bracket 18. A leaf spring 46 also extends between the upper surface of arm 34 and the lower surface of the shorter horizontal leg 20 of mounting bracket 18, thereby connecting arm 34 to the leg 20.

The free end of arm 34 is placed in abutment with a surface 48 forming a shoulder on a cam 50 mounted on one end of the continuously driven roller or shaft 30 extending beyond the right-hand side plate 22. Cam 50 is freely rotatable about driven roller or shaft 30. When the free end of arm 34 is in abutment with the shoulder 48 of cam 50, the cam is precluded from rotating in a clockwise direction as viewed in FIGS. 1 and 2. Driven roller or shaft 30 is connected to cam 50 by a coil spring 52 extending between a vertical pin 54 on a flat surface 56 of shaft 30 and a pin 58 extending outwardly from a side surface of cam 50 and beyond the side surface of shaft 30. Accordingly, shaft 30 can rotate in a clockwise direction as viewed in FIGS. 1 and 2 while cam 50 remains stationary and in abutment with the end of pivot arm 34. As shaft 30 rotates, spring 52 will elongate or expand and ride over center and return or contract as shaft 30 rotates relative to stationary cam 50. Stated differently, the extension of pin 58 beyond the side surface of shaft 30, enables the coiled spring 52 to ride out over flat surface 56 and return during each revolution of shaft 30, relative to cam 50.

Cam 50 is connected via a coupling member 60 to a large gear 62 all of which are freely rotatable on shaft 30. Gear 62 is in mesh with an idler gear 64 which in turn is in mesh with a pinion 66 mounted on extension shaft 68 connected to roller 26. Idler gear 64 assures that pinion 66, shaft 68, and roller 26 will rotate in the same direction as shaft 30 when cam 50 is permitted to rotate with shaft 30 upon activation of the clutch mechanism 10.

In operation, a web of sheet-like material is fed between roller pairs 24, 26 and 28, 30 for processing. Roller 24 is hollow and is provided with small openings 70 so that a vacuum can be induced within the interior of roller 24 by drawing air from the interior thereof through conduits 72 and 74 connected to the interior of the roller to hold the sheet-like material in position between rollers 24 and 26 while the web is being processed. Simultaneously, roller 26, which would feed the sheet material between rollers 28 and 30, is held stationary by clutch mechanism 10.

Figure 2:
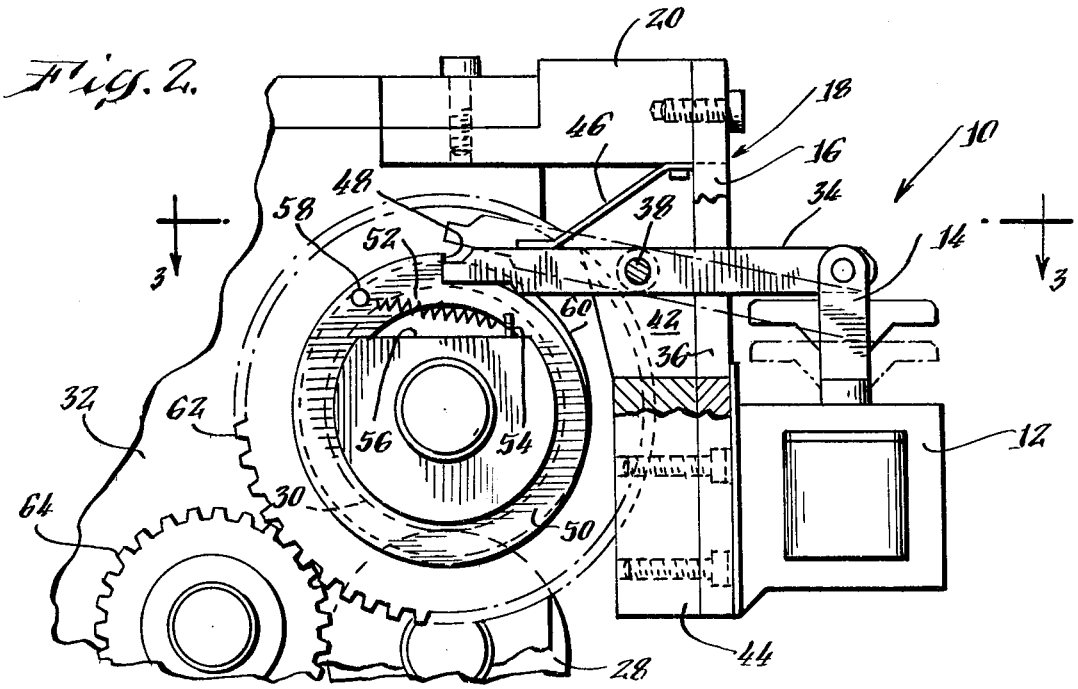
FIG. 2 is a side view in elevation, partly in section, of the clutch mechanism illustrated in FIG. 1.

When the vacuum within the interior of roller 24 is activated, the pivot arm 34 is in its horizontal position as seen in FIGS. 1 and 2 and the free end of the arm is in abutment with the shoulder 48 on cam 50. Accordingly, continued rotation of shaft 30 will have no effect in feeding of the web as the gear 62 is inactive and pinion 66 will not rotate to drive shaft 26 to feed the sheet material. While shaft 30 rotates relative to idler shaft 28, the sheet material is not fed forward because of the vacuum holding the sheet to the surface of roller 24.

Upon deactivation of the vacuum induced within the interior of roller 24 and the completion of the work on the sheet, an electric signal is sent to solenoid 12 to retract its plunger 14 as illustrated in phantom lines in FIG. 2. Retraction of plunger 14 causes pivot arm 34 to pivot about pin 38, as indicated in phantom in FIG. 2, and causes its free end to be raised relative to shoulder 48 of cam 50. When this occurs, shaft 30 through overcenter spring 52 will cause cam 50 to rotate in a clockwise direction, which in turn through coupling member 60 causes clockwise rotation of large gear 62. Rotation of gear 62 and the spring idler gear 64 causes pinion 66 to rotate in a clockwise direction to rotate feed roller 26. A web between rollers 24 and 26 can thus be advanced by roller 26 through rollers 28 and 30 until vacuum is again induced within the interior of roller 24.

Leaf spring 46, being bent upon upward movement of pivot arm 34, will exert a return force upon the arm 34 to cause the free end of arm 34 to re-seat and abut shoulder 48 on cam 50 prior to the next revolution of cam 50. Accordingly, the web passing between rollers 24, 26 and 28, 30 is advanced a precise amount and the vacuum within the interior of roller 24 is induced at that time so that reprocessing of the web can be commenced.

What is claimed as new is:

1. In a web feeding apparatus including a pair of rollers for intermittently advancing a sheet-like web therebetween, one of said rollers being adapted to be driven, a clutch mechanism for intermittently connecting a continuously rotating drive means to said one roller comprising:

a solenoid having a reciprocable plunger, a pivotable arm connected at one end to said plunger, said drive means including continuously driven rotatable shaft means, rotatable cam means mounted on said shaft means having a shoulder normally in abutment with the other end of said pivotable arm, gear means between said cam means and said one roller for rotating said one roller upon rotation of said cam means, and driving connection means between said shaft means and cam means for rotatably driving said cam means from said shaft means upon pivoting of said arm, said driving connection means including an elongated coiled spring, with one end of said spring being connected to said cam means, and with the opposed end of said spring being connected to a point on said shaft means radially outward from the rotational axis thereof, such that when said arm is in abutment with said shoulder on said cam means, said cam means remains stationary while said shaft means continuously rotates and whereby said cam means is rotatably driven by said shaft means when said arm is pivoted, by said plunger, out of abutment with said shoulder on said cam means in response to an electrical signal to said solenoid.

2. In a web feeding apparatus in accordance with claim 1 wherein said gear means includes a pinion fixed to said one roller, a gear coupled to said cam means, and an idler gear between said gear coupled to said cam means and said pinion fixed to said one roller.

3. In a web feeding apparatus in accordance with claim 1 including bracket means for mounting said solenoid, said pivotable arm extending through an elongated slot in said bracket means into abutment with the shoulder on said cam means, and a leaf spring between said bracket means and said pivotable arm for returning said arm into abutment with the shoulder on said cam means after pivoting of said arm by said plunger in response to an electrical signal from said solenoid.

4. In a web feeding apparatus in accordance with claim 1 wherein the other of said rollers includes means connected thereto for inducing a vacuum in the interior thereof.

* * * * *